US005967078A

United States Patent [19]

Eilert

[11] Patent Number: 5,967,078

[45] Date of Patent: Oct. 19, 1999

[54] DETACHABLE WEAR STRIPS FOR THE HULL OF A WATERCRAFT

[75] Inventor: John R. Eilert, Fond du Lac, Wis.

[73] Assignee: Brunswick Corporation, Lake Forest, Ill.

[21] Appl. No.: 08/936,076

[22] Filed: Sep. 23, 1997

[51] Int. Cl.[6] ..... B63B 5/24; B63B 59/02

[52] U.S. Cl. ..... 114/357; 114/219

[58] Field of Search ..... 114/219, 357, 114/361, 271, 140, 291, 364, 267, 39; 296/41; 293/128

[56] References Cited

U.S. PATENT DOCUMENTS

| | | | |
|---|---|---|---|
| D. 335,484 | 5/1993 | Moyle et al. . | |
| 2,990,802 | 7/1961 | Ong et al. . | |
| 3,055,022 | 9/1962 | Vallquist . | |
| 3,220,026 | 11/1965 | Lichti . | |
| 3,225,731 | 12/1965 | McCulley | 114/219 |
| 3,579,681 | 5/1971 | Pope, III et al. | 441/74 |
| 3,747,550 | 7/1973 | Stoeberl | 114/39 |
| 4,002,362 | 1/1977 | Sears et al. | 293/62 |
| 4,353,584 | 10/1982 | Lovett | 293/1 |
| 4,365,577 | 12/1982 | Heinrich | 114/267 |
| 4,741,284 | 5/1988 | Madison | 114/357 |
| 4,751,891 | 6/1988 | Wilson . | |
| 4,762,080 | 8/1988 | Pearson . | |
| 4,803,942 | 2/1989 | Dren et al. . | |
| 4,892,055 | 1/1990 | Schad | 114/357 |
| 4,909,172 | 3/1990 | Hamby . | |
| 4,920,907 | 5/1990 | Richter | 114/219 |
| 4,962,719 | 10/1990 | Hughes et al. . | |
| 4,972,791 | 11/1990 | Williams . | |
| 5,018,997 | 5/1991 | Guptill . | |
| 5,357,890 | 10/1994 | Mason, Jr. et al. . | |
| 5,485,801 | 1/1996 | Gibbs . | |

*Primary Examiner*—Sherman Basinger
*Assistant Examiner*—Patrick Muldoon
*Attorney, Agent, or Firm*—Andrus, Sceales, Starke & Sawall

[57] ABSTRACT

A watercraft hull having at least one removable protective wear strip. The watercraft hull includes at least one mounting groove extending along the longitudinal length of the watercraft hull along the lowermost portion of the hull. A wear strip is removably attached to each mounting groove such that when the watercraft hull is pulled from the water, the wear strip contacts the shore to prevent damage to the watercraft hull. A series of attachment devices is embedded in the watercraft hull along the mounting groove. A series of connectors passes through the wear strip to removably attach the wear strip to the mounting groove contained in the watercraft hull. When the wear strip becomes worn, the wear strip can be removed from the watercraft hull and replaced with a new wear strip.

7 Claims, 2 Drawing Sheets

FIG. 4
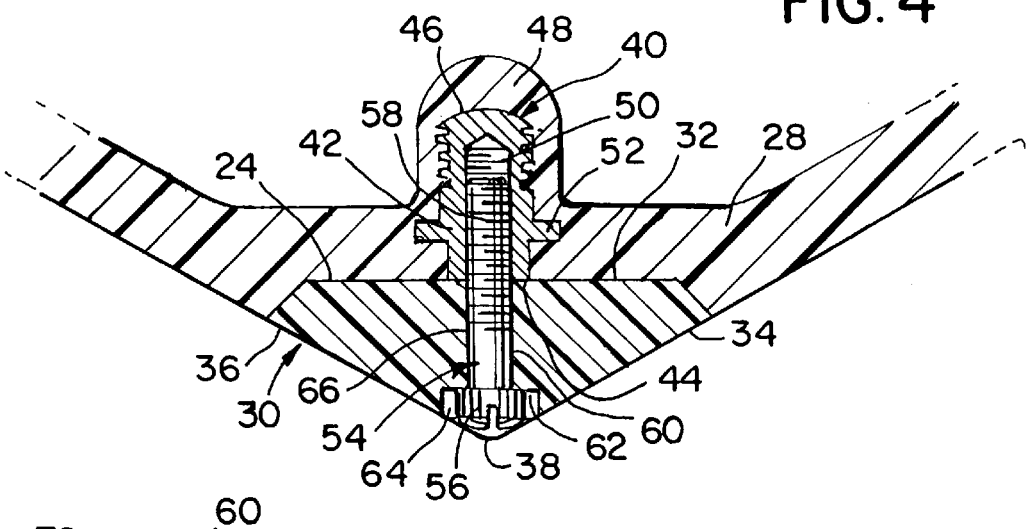
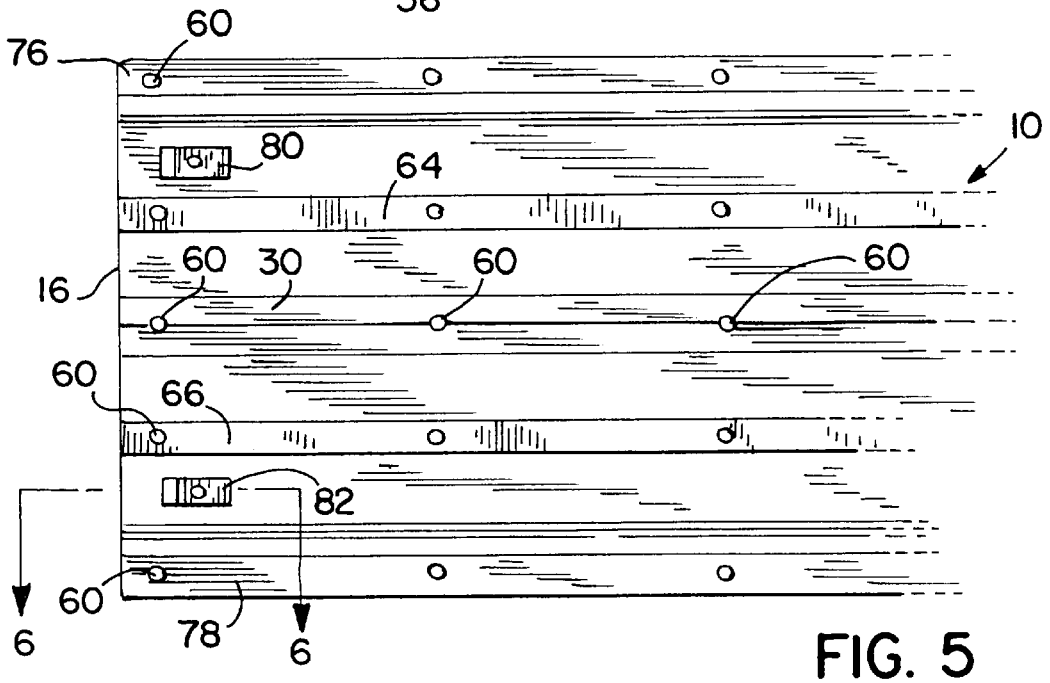
FIG. 5
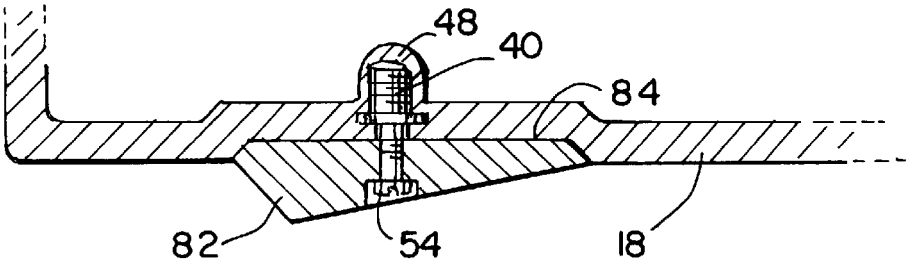
FIG. 6

DETACHABLE WEAR STRIPS FOR THE HULL OF A WATERCRAFT

BACKGROUND OF THE INVENTION

The present invention relates to the hull construction of a watercraft. More specifically, the invention relates to a hull that includes at least one removable wear strip that can be removed and replaced to prevent permanent damage to the watercraft hull.

Many types of watercraft, such as motor boats, jet boats, personal watercraft, sail boats, and canoes are formed of a fiberglass composite material or molded plastic that can become easily damaged or severely scratched as a result of a forcible impact or collision with sand, gravel, rocks, or other obscured objects or debris found in the water. Typically, after use, each of the small watercraft identified above is pulled up out of the water and onto a beach or shore. When the watercraft is being pulled out of the water, the lowermost portion of the hull of the watercraft (generally encompassing portions of the bow, keel and stern) is particularly susceptible to scratching and abrasion. The abrasions in the hull promote corrosion and structural weakening of the hull. Such corrosion and weakening of the hull can, particularly if the hull is fabricated from fiberglass, necessitate repair or replacement of the entire damaged portion of the watercraft.

Traditionally, the walls forming the bow and keel of the watercraft taper together to form a leading edge that structurally encourages the hydrodynamic flow of water across the exterior surface of the hull as the watercraft moves through the water. Serious damage to the keel and/or bow of the watercraft can create substantial dragging or suction forces against the motion of the immersed watercraft, which can seriously affect the overall hydrodynamic performance of the watercraft.

Repairing and/or replacing the hull of the watercraft is customarily costly and greatly inconvenient for the watercraft owner. Accordingly, the need to protect the keel and/or bow of the watercraft from abrasive wear and structural damage has resulted in various options available for protecting the hull of the watercraft.

In an attempt to protect at least a portion of the lowermost area of a watercraft from structural damage, bow protectors have been developed. A serious disadvantage associated with the bow protectors currently available is the general inability of the bow protector to adequately conform to the keel or bow of the particular watercraft on which it is being used. Traditionally, prior art bow protectors are designed having a rigid "V-shaped" configuration. Since each type of watercraft has its own bow and keel configuration, the standard prior art bow protector is unable to provide sufficient universal conformity due to the various sizes and shapes of watercraft on which it is used.

Additionally, there are significant disadvantages associated with the reduction in the overall hydrodynamic performance of a watercraft as a result of a non-conforming prior art bow protector rigidly secured over the keel or bow of the watercraft. In many modern watercraft designs, a large amount of engineering and design work is spent during development of the hull configuration. The engineering and design work done in developing the hull centers on optimizing the hydrodynamic performance of the watercraft by forming the hull in a specific manner. Since the prior art bow protectors are constructed of a single design for use on a variety of watercraft, the currently available bow protectors can have a negative effect on the watercraft performance and can negate the design and engineering work invested to develop the watercraft.

In addition to the disadvantages previously discussed, many of the prior art bow protectors currently available are attached to the bow and/or keel of the watercraft by the use of an adhesive. Such prior art bow protectors are shown in U.S. Pat. Nos. 4,762,080; 4,909,172; and 5,485,801. In each of these bow protectors, the bow protector is attached to the watercraft hull by a powerful adhesive. Along with the previously mentioned hydrodynamic disadvantages, the adhesively attached bow protectors present a problem when they need to be replaced after a period of continuous usage. Since the adhesive must be strong enough to hold the bow protector in place, the adhesive is often very difficult to remove without damaging the watercraft hull. Therefore, when the bow protector becomes extremely worn, it is very difficult to remove the protector without damaging the underlying hull.

Finally, many of the currently available watercraft bow protectors have practical disadvantages related to the method of installing the bow protectors to the watercraft. For example, in order to properly install prior art bow protectors over a non-conforming keel or bow of a watercraft, at least a pair of skilled installers are typically required to bend or alter the shape of the bow protector to generally conform to the keel or bow of the watercraft. Thus, the prior art bow protectors require generally skilled technicians with special training and special tools to properly install the bow protectors.

Therefore, although bow protectors have been known in the prior art, the currently available bow protectors suffer from several disadvantages, such as the negative effect on the watercraft's hydrodynamic performance and the inadequate replaceability of a worn protector. Thus, it would be particularly desirable to provide a protective device that does not adversely effect the watercraft's performance and is easily replaceable when worn.

SUMMARY OF THE INVENTION

The present invention is a watercraft hull which incorporates at least one removable wear strip that protects the hull of the watercraft from permanent damage or abrasion.

The watercraft hull of the present invention is a molded hull formed from either fiberglass or some type of sturdy material such as plastic or other synthetic material. The watercraft hull is molded with at least one mounting groove formed in the bottom walls of the hull. Preferably, the hull includes a mounting groove extending from the bow of the hull to the transom in the location where a conventional keel would normally be located. The keel mounting groove includes a mounting surface extending along the entire longitudinal length of the watercraft hull.

A plurality of attachment devices are embedded in the molded watercraft hull in a single, spaced row extending along and contained within the keel mounting groove. Each of the attachment devices is completely encapsulated within a molded expanded section of the hull that extends into the internal cavity formed by the watercraft hull. The attachment devices each include an internally threaded bore and a flange extending around the outer diameter of the attachment device body. The flange contained on the attachment device prevents the attachment device from being pulled out of the expanded section of the molded watercraft hull.

The watercraft hull of the invention includes a wear strip positioned within each of the mounting grooves formed in the bottom of the watercraft hull. Each of the wear strips is formed from a durable piece of material that can withstand repeated contact with abrasive surfaces when the watercraft is beached on-shore. The wear strip positioned within the keel mounting groove has a shape corresponding to the desired keel configuration of the watercraft.

The keel wear strip includes a plurality of spaced attachment holes extending therethrough such that when the keel wear strip is positioned within the keel mounting groove, the attachment holes in the keel wear strip are aligned with the internally threaded bores contained in the attachment devices encapsulated in the watercraft hull. When the keel wear strip is correctly positioned, a plurality of connectors are inserted through the attachment holes in the keel wear strip and are retained within the attachment devices to securely hold the keel wear strip in place along the watercraft hull. Since the keel wear strip defines the keel of the watercraft, the keel wear strip will contact the shore when the watercraft is dragged out of the water. Thus, the keel wear strip will become abraded and scratched during continuous usage. When the keel wear strip becomes worn, the connectors are removed and the worn keel wear strip is replaced by a new keel wear strip.

In another feature of the invention, the molded watercraft hull can include mounting grooves extending along the longitudinal axis of the watercraft hull in the location conventional strakes would be formed. Additionally, the watercraft can include mounting grooves extending along the longitudinal axis of the watercraft hull in the location conventional chines would be formed. In much the same way as the keel mounting groove, both the strake and chine mounting grooves include a plurality of encapsulated attachment devices in a single row extending along and contained within the strake mounting grooves and chine mounting grooves. Like the keel wear strip, strake wear strips are removably attached to the strake mounting grooves contained on the watercraft hull. Likewise, chine wear strips are attached to the chine mounting grooves contained on the watercraft hull. Thus, when the watercraft is pulled ashore, the keel wear strip, the strake wear strips, and the chine wear strips contact the ground to prevent scratches and abrasions to the watercraft hull.

Since the keel wear strip, strake wear strips, and chine wear strips are each contained within a mounting groove formed in the watercraft hull during the molding process, the hydrodynamic effect the replaceable wear strips have on the watercraft performance can be considered when the hull is being designed. Thus, the replaceable wear strips do not have any unexpected adverse effect on the watercraft's hydrodynamic performance.

In an additional feature of the invention, the removable wear strips can be designed having different profiles that can selectively alter the performance of the watercraft. In this manner, the hydrodynamic performance of the watercraft hull can be modified by simply replacing the wear strips.

Other objects and advantages of the present invention will become apparent in the following disclosure.

BRIEF DESCRIPTION OF THE DRAWINGS

FIG. 4 is a sectional view showing the encapsulated attachment device and keel wear strip in accordance with the present invention.

FIG. 5 is a bottom plan view of the watercraft hull incorporating the various wear strips of the present invention.

FIG. 6 is a sectional view taken along line 6—6 in FIG. 5 showing the connection between the watercraft hull and a skid plate in accordance with the present invention.

DETAILED DESCRIPTION OF THE INVENTION

Figure 1:
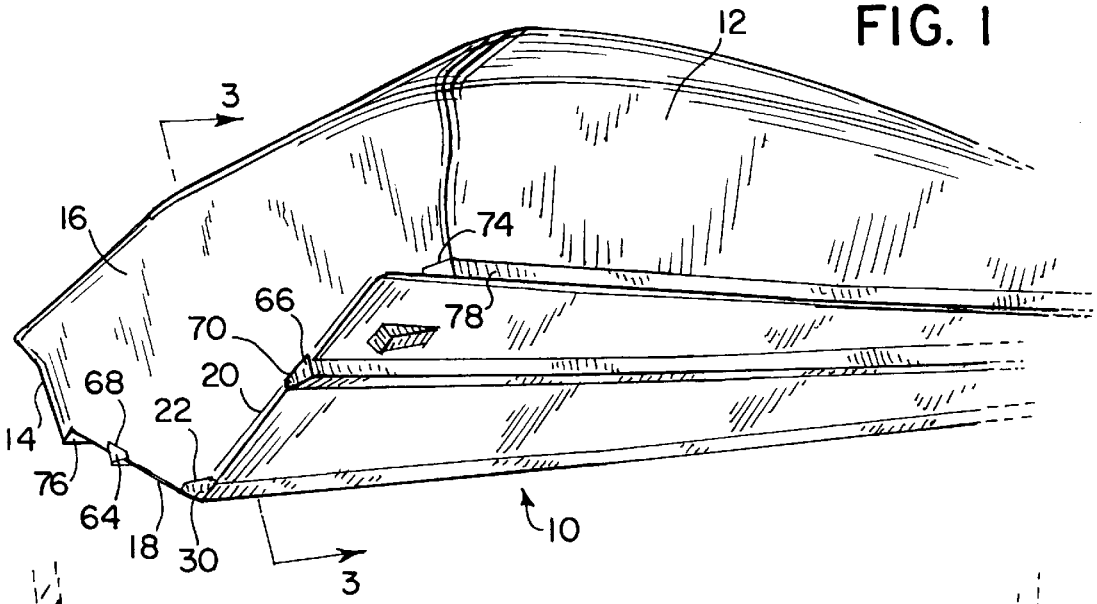
FIG. 1 is a partial perspective view of a watercraft hull incorporating the replaceable wear strips in accordance with the present invention.

Referring first to FIG. 1, thereshown is the watercraft hull of the present invention generally referred to by reference numeral 10. The watercraft hull 10 extends lengthwise along a longitudinal axis and generally includes a pair of side walls 12 and 14, a transom 16, and a pair of bottom walls 18 and 20. The watercraft hull 10 defines an internal cavity 19 that displaces enough water to keep the watercraft afloat. In the preferred embodiment of the invention, the entire watercraft hull 10 is a single molded structure formed from either fiberglass or a durable plastic material. During construction of the watercraft hull 10, the watercraft hull 10 is preferably spun molded in a conventional manner. Thus, the side walls 12 and 14, the transom 16 and the bottom walls 18 and 20 are integrally formed with each other to form the single piece watercraft hull 10.

In a typical watercraft having a V-shaped hull, the bottom walls 18 and 20 taper together from the side walls 12 and 14 to create the V-shaped bottom of the watercraft hull. The point at which the bottom wall 18 joins the bottom wall 20 defines a leading edge or keel 21 that structurally encourages the hydrodynamic flow of water across the exterior surface of the hull as the watercraft moves through the water. Since the keel 21 is typically the lowest portion of the watercraft hull, the keel 21 contacts the shore or landing when the watercraft 10 is pulled out of the water. Thus, the keel 21 typically becomes scratched and damaged during repeated use of the watercraft.

Figure 2:
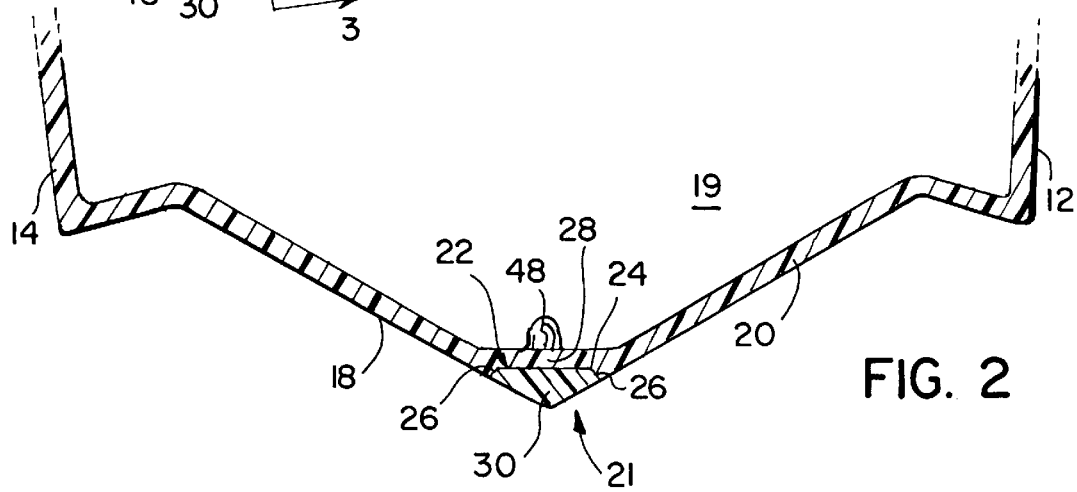
FIG. 2 is a sectional view of the watercraft hull incorporating a keel wear strip in accordance with the present invention.

In the watercraft hull 10 of the present invention, the side walls 18 and 20 taper together from the side walls 12 and 14 in a conventional manner. However, unlike a conventional watercraft hull, the keel 21 includes a mounting groove 22 formed along the lowest portion of the watercraft hull 10 extending along the longitudinal axis of the hull 10. As can be seen in FIG. 2, the bottom wall 18 is joined to the bottom wall 20 by the keel mounting groove 22. The keel mounting groove 22 includes a flat mounting surface 24 and a pair of side edges 26. In the preferred embodiment of the invention, the keel mounting groove 22 extends along the lowest portion of the watercraft hull 10 from the transom 16 to the bow (not shown) of the watercraft hull 10. The watercraft hull 10 includes a relatively flat wall 28 which joins each of the bottom walls 18 and 20, such that the watercraft hull 10 is a solid member. In the preferred embodiment of the invention, the watercraft hull 10 is originally molded including the keel mounting groove 22. Alternatively, it is contemplated that the watercraft hull 10 could be formed with a conventional keel, and a large portion of the keel could be physically removed to define the keel mounting groove 22.

Referring initially to FIGS. 1 and 2, the keel 21 further includes a wear strip 30 that is physically attached to the keel mounting groove 22 running longitudinally along the length of the watercraft hull 10. Since the keel wear strip 30 defines the lowermost portion of the watercraft hull 10, the keel wear strip 30 makes physical contact with the shore or landing when the watercraft is pulled from the water. Thus, the keel wear strip 30 prevents wear and abrasion to the bottom walls 18 and 20 of the watercraft hull 10.

Referring now to FIG. 4, the keel wear strip 30 is defined by an inside wall 32, and a pair of outer walls 34 and 36. The outer walls 34 and 36 join together to define a lower edge surface 38, which is the lowermost portion of the watercraft hull 10 when the keel wear strip 30 is attached to the keel mounting groove 22. In the preferred embodiment of the invention, the keel wear strip 30 is an extruded piece of high density plastic, such as polypropylene. However, the keel wear strip 30 can be constructed from a variety of materials, as long as the keel wear strip 30 is durable enough to handle the repeated contact with the shore, trailers, underwater objects or the bottom for a sufficient period of time.

As can be understood in FIG. 4, the inside wall 32 of the keel wear strip 30 is placed in physical contact with the mounting surface 24 of the keel mounting groove 22. Additionally, the inside wall 32 of the keel wear strip 30 includes a pair of angled walls that correspond to the pair of side edges 26 of the keel mounting groove 22. Thus, the inside wall 32 of the keel wear strip 30 generally corresponds to the overall shape of the keel mounting groove 22.

In the preferred embodiment shown in FIG. 4, the slope of the outer walls 34 and 36 of the keel wear strip 30 generally corresponds to the slope of the bottom walls 18 and 20 of the watercraft hull 10. In this manner, the keel wear strip 30 generally conforms to the overall shape of the bottom walls 18 and 20 of the watercraft hull 10. It is contemplated by the inventor that the configuration of the keel wear strip 30 could be modified in order to change the performance of the watercraft hull 10. For example, the overall height of the keel wear strip 30 could be increased such that the angle between the outer walls 34 and 36 decreases. In any event, the configuration of the keel wear strip 30 can be specifically designed to modify the hydrodynamic effect the keel wear strip 30 will have on the watercraft hull 10.

To facilitate attachment of the keel wear strip 30 to the keel mounting groove 22, a plurality of attachment devices 40 are positioned along the keel mounting groove 22. Each of the attachment devices 40 includes a body 42 extending between a first end 44 and a second end 46. As can be seen in FIG. 4, each of the attachment devices 40 is completely embedded in an expanded bulb-like section 48. The expanded section 48 extends inward from the flat bottom wall 28 into the internal cavity 19 created by the watercraft hull 10. In this manner, each of the attachment devices 40 is completely encapsulated in the molded watercraft hull 10 to prevent leakage into the internal cavity 19.

Each of the attachment devices 40 includes an internally threaded bore 50 extending into the body 42 from the first end 44 of the attachment device 40. As can be seen in FIG. 4, the first end 44 of the attachment device 40 is mounted flush with the mounting surface 24 of the keel mounting groove 22. Thus, the opening to the internally threaded bore 50 is also flush with the mounting surface 24 of the keel mounting groove 22.

Each of the attachment devices 40 includes a radial flange 52 extending completely around the body 42. The flange 52 has an outer diameter greater than the outer diameter of the attachment device body 42, such that the flange 52 prevents the attachment device 40 from being pulled out of the expanded section 48 of the watercraft hull 10.

In the preferred embodiment of the invention, the plurality of attachment devices 40 are positioned along the entire longitudinal length of the keel mounting groove 22. Preferably, the individual attachment devices 40 are spaced approximately twelve inches apart in a straight line extending along the center of the keel mounting groove 22. In the preferred embodiment of the invention, the plurality of attachment devices 40 are positioned in the mold for the watercraft hull 10 before the hull is molded, such that the attachment devices 40 are directly molded into the watercraft hull 10. Thus, after the watercraft hull 10 has been molded, a plurality of expanded sections 48, each containing an attachment device 40, will extend into the internal cavity 19 at approximately twelve inch intervals along the flat wall 28 defining the lowermost portion of the hull 10. Since each of the attachment devices 40 is completely encapsulated in the watercraft hull 10, the attachment devices 40 do not create any possibility for leakage into the internal cavity 19 of the watercraft hull 10.

The keel wear strip 30 is attached to the keel mounting groove 22 by a plurality of connectors 54. In the preferred embodiment of the invention, each of the connectors 54 is a conventional screw having a head portion 56 and a threaded shaft 58. In order to accommodate the connectors 54, a plurality of attachment holes 60 are formed in the keel wear strip 30. Each of the attachment holes 60 preferably includes a shoulder 62 between an access opening 64 and a narrow connector passage 66. As can be seen in FIG. 4, an individual connector 54 is inserted into each of the attachment holes 60, such that the threaded shaft 58 interacts with the internally threaded bore 50 contained in the attachment device 40. The connector 54 is tightened until the connector head 56 contacts the shoulder 62 to securely hold the keel wear strip 30 in place along the keel mounting groove 22.

Referring now to FIG. 5, it can been seen that the attachment holes 60 are evenly spaced along the keel wear strip 30. In the preferred embodiment of the invention, the attachment holes 60 contained in the keel wear strip 30 are positioned approximately twelve inches apart, such that the attachment holes 60 are aligned with the series of attachment devices 40 molded into the keel mounting groove 22 contained in the watercraft hull 10. In this manner, the keel wear strip 30 can be secured to the watercraft hull 10.

As can be understood in FIG. 4, when the keel wear strip 30 is attached to the keel mounting groove 22, the head 56 of each connector 54 is positioned inside the outer profile of the keel wear strip 30, as defined by the outer walls 34 and 36. Thus, as the watercraft is dragged along the ground, the keel wear strip 30 initially prevents the connectors 54 from contacting the ground. Over time, as the watercraft is used, the repeated contact between the keel wear strip 30 and the ground causes the keel wear strip 30 to become worn down. As the keel wear strip 30 wears, the connectors 54 will eventually contact the shore or landing over which the watercraft is dragged. At this time, the series of connectors 54 should then be loosened and the keel wear strip 30 removed and replaced by a new wear strip. In this manner, the keel wear strip 30 prevents permanent damage to the watercraft hull 10, since the keel wear strip 30 defines the keel 21 and will be the surface upon which the watercraft contacts the shore or landing.

In addition to preventing damage to the bottom walls 18 and 20 of the watercraft hull 10, the configuration of the keel wear strip 30 can be changed to modify the hydrodynamic characteristics of the watercraft hull 10. For example, the overall height of the keel wear strip 30 could be increased or decreased, depending upon the desired hydrodynamic performance of the watercraft.

Although the keel wear strip 30 is attached to the keel mounting strip 22 by a series of attachment devices 40 and connectors 54 in the preferred embodiment of the invention, it is contemplated by the inventors that the keel wear strip 30 and the keel mounting groove 22 could be constructed such that the keel wear strip 30 would slide into the keel mounting groove and be retained by flanges or slots contained in the keel mounting groove 22. Thus, the keel wear strip 30 would be retained by the physical interaction between the keel wear strip 30 and the keel mounting groove 22 without the need for any external attachment devices or connectors. This type of connection between the keel wear strip 30 and the keel mounting groove 22, however, would increase the difficulty in molding the watercraft hull 10, since the keel mounting groove 22 would include relatively complex grooves or tabs.

Figure 3:
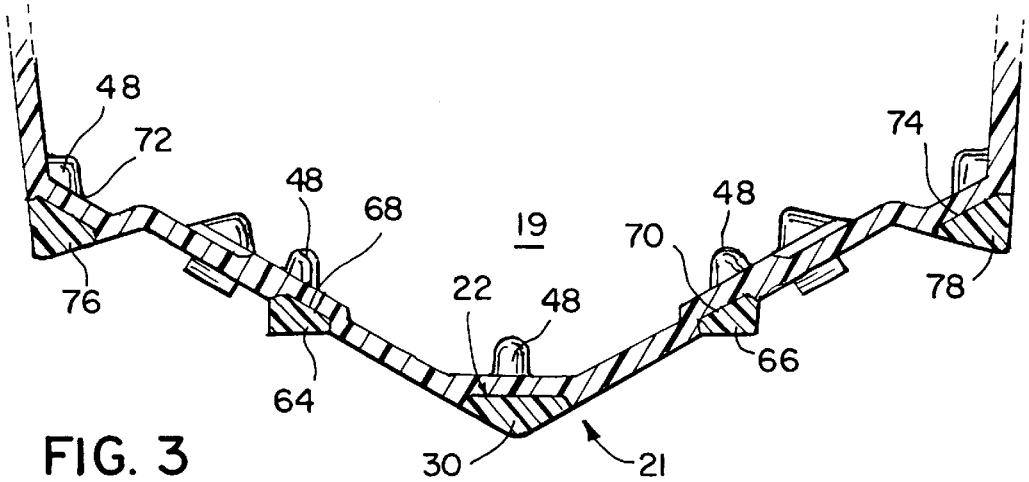
FIG. 3 is a sectional view taken along line 3—3 of FIG. 1 showing a series of wear strips in accordance with the present invention.

In addition to the keel wear strip 30 positioned along the lowermost portion of the watercraft hull 10, additional wear strips can also be attached to the watercraft hull 10 to further prevent damage to the bottom walls 18 and 20 of the watercraft hull 10. Referring to FIGS. 1 and 3, thereshown is an embodiment of the watercraft hull 10 incorporating a series of wear strips. The first set of wear strips includes wear strip 64 and wear strip 66, each of which is positioned along the watercraft hull 10 on opposite sides of the keel 21 in a location where conventional strakes would be located. Each of the strake wear strips 64 and 66 is retained in its own mounting groove 68 and 70, respectively. The strake mounting grooves 68 and 70 are similar to the keel mounting groove 22 previously discussed. Each of the strake mounting grooves 68 and 70 is a removed portion of one of the bottom walls 18 and 20 of the watercraft hull 10. The strake mounting grooves 68 and 70 extend along the longitudinal axis of the watercraft hull 10 and are formed during the initial molding process of the watercraft hull 10. As was the case with the keel mounting groove 22, a plurality of attachment devices 40 are mounted in the watercraft hull in a single line extending along the longitudinal length of each of the strake mounting grooves 68 and 70.

Each of the attachment devices 40 contained in the strake mounting grooves 68 and 70 is encapsulated in an expanded section 48 of the watercraft hull 10 in a similar manner as discussed with the keel mounting groove 22. Likewise, each of the strake wear strips 64 and 66 includes a plurality of attachment holes 60 that are aligned with the attachment devices 40 positioned along the strake mounting grooves 68 and 70. Thus, when the strake wear strips 64 and 66 are positioned in the corresponding strake mounting grooves 68 and 70, a second series of connectors 54 is used to secure the strake wear strips 64 and 66 to the watercraft hull 10.

Referring to FIG. 5, the attachment holes 60 contained in each of the strake wear strips 64 and 66 are positioned approximately twelve inches apart such that the strake wear strips 64 and 66 can be removably attached to the watercraft hull 10. As was the case with the keel mounting groove 22, the attachment devices 40 are positioned within the mold before the watercraft hull 10 is formed, such that each of the attachment devices 40 is completely encapsulated in an expanded section 48 of the molded watercraft hull 10 to prevent leakage into the internal cavity 19.

In an additional embodiment of the invention, a second pair of mounting grooves 72 and 74 is formed in the watercraft hull 10 on each side of the keel 21 in the location where conventional chines would be found. As was the case with the keel mounting groove 22 and the strake mounting grooves 68 and 70, each of the chine mounting grooves 72 and 74 are formed in the watercraft hull 10 during the initial molding process. Each of the chine mounting grooves 72 and 74 extends generally along the longitudinal length of the watercraft hull 10 and include a plurality attachment devices 40 embedded in a single line extending along the center of the respective chine mounting groove 72 and 74.

Chine wear strips 76 and 78 are attached to the chine mounting grooves 72 and 74, respectively, in a similar manner as previously discussed with respect to the keel wear strip 30. Each of the chine wear strips 76 and 78 includes a plurality of attachment holes 60, such that a plurality of connectors 54 can pass through the attachment holes 60 and be retained in the attachment devices 40 contained in the expanded sections 48 along the longitudinal length of the chine grooves 72 and 74. In this manner, the plurality of connectors 54 can be used to removably attach each of the chine wear strips 76 and 78 to the watercraft hull 10 of the present invention.

Since the watercraft hull 10 shown in the preferred embodiment of the present invention is V-shaped, when the watercraft hull 10 is pulled out of the water, it is common for the V-shaped watercraft hull 10 to tip to one side or the other. For example, when the watercraft hull 10 tips onto the starboard side, the keel wear strip 30, the strake wear strip 66 and the chine wear strip 78 will contact the shore. Thus, by using a plurality of wear strips rather than just the single keel wear strip 30, damage can be prevented to the watercraft hull 10 when it tips to either side. When any of the wear strips become worn, the connectors 54 can simply be removed and the wear strip replaced with a new wear strip.

Although the removable wear strips of the present invention have been discussed as attached to a V-shaped watercraft hull 10, it is contemplated by the inventor that similar wear strips could be removably attached to the hull of a flat-bottomed watercraft. In a flat-bottomed watercraft, the wear strips would be positioned in mounting grooves formed along the lowermost portion of the watercraft hull. In this manner, the wear strips would contact the shore when the watercraft is pulled out of the water to prevent damage to the flat-bottomed watercraft hull.

Referring now to FIGS. 5 and 6, a pair of skid plates 80 and 82 can be attached to the bottom walls 18 and 20 of the watercraft hull 10. Each of the skid plates 80 and 82 is contained within a skid plate groove 84 formed in the watercraft hull 10, as can be seen in FIG. 6. Each of the skid plate grooves 84 is an indentation formed in the bottom wall 18 or 20 of the watercraft hull 10 during the initial molding process. An attachment device 40 is positioned in each of the skid plate grooves 84 such that the skid plates 82 and 84 can be attached to the watercraft hull 10. As was previously the case, each of the attachment devices 40 is encapsulated in an expanded section 48 of the hull 10 extending into the internal cavity 19. The pair of skid plates 80 and 82 are preferably formed from the same wear resistant material used to form the wear strips previously discussed. The pair of skid plates 80 and 82 provide further protection for the rear portion of the watercraft hull 10.

Although the strake wear strips 64 and 66 and the chine wear strips 76 and 78 have been discussed as being particularly useful in preventing damage to the bottom walls 18 and 20 of the watercraft hull 10, it is also contemplated by the inventor that the configuration of the strake wear strips 64 and 66 and the chine wear strips 76 and 78 could be designed to modify the hydrodynamic performance of the watercraft hull 10. Since conventional strakes and chines affect the hydrodynamic performance of a watercraft hull, particularly during turning, it is contemplated that the removable wear strips attached to the watercraft hull 10 could be specifically engineered to have a desired effect on the watercraft performance. Thus, if it is desired to change the watercraft performance, the removable wear strips attached to the strake and chine locations could be removed and replaced by the desired configuration. In this manner, the hydrodynamic performance of the watercraft hull 10 can be modified by simply removing the wear strips and replacing them with wear strips having the desired characteristics.

I claim:

1. A watercraft hull comprising:

a molded body extending along a longitudinal axis;

at least one mounting groove formed in the molded body and extending generally parallel to the longitudinal axis of the molded body;

a wear strip removably attached to said mounting groove;

at least two attachment devices embedded in said mounting groove formed in the molded body, the attachment devices being spaced from each other along the longitudinal length of said mounting groove, wherein said wear strip is removably attached to said mounting groove by a plurality of connectors, each connector being received in one of the attachment devices embedded in said mounting groove, said wear strip includes a plurality of attachment holes extending completely through said wear strip, the attachment holes being aligned with the attachment devices when said wear strip is positioned in said mounting groove, such that the plurality of connectors pass through the attachment holes in said wear strip and are retained in the attachment devices to securely attach said wear strip to the watercraft hull, said connectors being recessed above a lower wear surface of said wear strip, said wear strip wearing along said lower surface and being usable until said lower surface becomes flush with said connectors.

2. A watercraft hull comprising:

a molded body extending along a longitudinal axis;

at least one mounting groove formed in the molded body and extending generally parallel to the longitudinal axis of the molded body;

a wear strip removably attached to said mounting groove;

at least two attachment devices embedded in said mounting groove formed in the molded body, the attachment devices being spaced from each other along the longitudinal length of said mounting groove, wherein each of the attachment devices includes a body extending between a first and a second end, a threaded bore extending into the attachment device body from the first end of the body, and a flange extending outwardly from the attachment device body and spaced from each of the first and second ends by respective portions of said molded body therebetween.

3. A watercraft hull of claim 2 wherein said mounting groove includes a flat mounting surface that interacts with an inside wall of said wear strip.

4. A watercraft hull of claim 3 wherein the first end of each attachment device is flush with the flat mounting surface of said mounting groove.

5. A watercraft hull comprising:

a molded body extending along a longitudinal axis, the molded body including a pair of bottom walls joined together to form a keel;

a first mounting groove formed in the keel of the molded body and extending generally parallel to the longitudinal axis of the molded body;

a second and a third mounting groove formed in the molded body, the second mounting groove being on an opposite side of the keel from the third mounting groove;

at least two attachment devices embedded in each of the first, second and third mounting grooves formed in the molded body, the attachment devices being spaced from each other along the longitudinal length of the mounting groove within which it is embedded;

a wear strip removably attached to each of the first, second and third mounting grooves by a series of connectors that are received in the attachment devices embedded in the respective mounting groove, each wear strip generally extending along the longitudinal axis of the molded body, wherein each of the attachment devices includes a body extending between a first and a second end, a threaded bore extending into the attachment device body from the first end of the body, and a flange extending outward form the attachment device body and spaced from each of said first and second ends by respective portions of said molded body therebetween.

6. The watercraft hull of claim 5 wherein the first end of each attachment device is flush with the mounting groove.

7. The watercraft hull of claim 6 further comprising a plurality of expanded sections extending inward from the molded body, such that each one of the attachment devices is completely encapsulated by the combination of the molded body and one of the expanded sections.

* * * * *